US005837920A

United States Patent [19]

Staiert et al.

[11] Patent Number: 5,837,920

[45] Date of Patent: Nov. 17, 1998

[54] BREAK ACTION CANNON

[75] Inventors: Richard W. Staiert, Coon Rapids; James E. Wildman, Plymouth, both of Minn.

[73] Assignee: FMC Corporation, Chicago, Ill.

[21] Appl. No.: 736,304

[22] Filed: Oct. 24, 1996

Related U.S. Application Data

[60] Continuation of Ser. No. 485,167, Jun. 7, 1995, abandoned, which is a division of Ser. No. 239,779, May 9, 1994, Pat. No. 5,591,932.

[51] Int. Cl.[6] ..... F41A 9/45

[52] U.S. Cl. ..... 89/7; 89/33.03; 42/10

[58] Field of Search ..... 42/10, 12, 11, 42/13, 8; 89/33.03, 33.05, 61, 45, 46, 47, 7, 20.4

[56] References Cited

U.S. PATENT DOCUMENTS 1,269,574 6/1918 Anthony et al. ..... 89/7

1,320,233 10/1919 Jamerson ..... 89/7

4,603,615 8/1986 Ashley ..... 89/7

FOREIGN PATENT DOCUMENTS 3817186 11/1989 Germany ..... 89/7

*Primary Examiner*—Stephen M. Johnson

*Attorney, Agent, or Firm*—Ronald C. Kamp

[57] ABSTRACT

The break action cannon invention disclosed herein enables weaponization and integration of complex fire control systems concurrent with projectile loading operations in a gun system such that superior firing cycle and efficient power and thermal management are achieved. A barrel is detachably shifted and tipped at an angle to accept a projectile while propellant charge supply systems and other firing preparations proceed simultaneously.

12 Claims, 3 Drawing Sheets

BREAK ACTION CANNON

This application is a continuation of application Ser. No. 08/485,167 filed on Jun. 7, 1995 now abandoned, which is a division of Ser. No. 08/239,779 Filed May 9, 1994 now U.S. Pat. No. 5,591,932.

FIELD OF THE INVENTION

This invention relates to a device and method for a break action cannon to deal with problems which arise in the weaponization and integration of regenerative liquid propellant system relative to deploying projectiles through gun tubes. The present invention enables, inter alia, efficient power and thermal management, superior firing cycle and high structural efficiency per unit weight, by enabling isolative loading of the gun tube.

SUMMARY OF THE INVENTION

The break action cannon of the present invention provides a device and method for segregating the process of loading a projectile into the gun tube from breech operations without impacting other critical firing cycle functions. Heretofore, devices and methods for regenerative liquid propellant breech loading include either swinging the breech block or vertically sliding a breech block or translating rearward and lifting a breech block to thereby provide unimpeded access to the gun tube. However, moving a regenerative liquid propellant breech assembly generally requires large power supply, complex structures and multiple controls. Further, existing devices are not flexible to promote integration into a weapon platform. Particularly, existing devices and methods, require complex gun mount structures which undermine firing time cycles and pose severe design restrictions.

The present invention provides significant advantages over the prior practice. It provides both a method and mechanism for concurrent projectile ram and propellant charge at a lower power requirement and reduced component size. Further, reductions in swept volume and appreciable reductions in inertial forces for breech opening are realized.

Primarily, one of the significant advantages proffered by the present invention includes simultaneous loading of a projectile into a gun tube while a propellant charge system is primed. The breech is opened and the barrel is detachably tipped at an angle to accept a projectile while the propellant supply system is revitalized as needed.

Specific advances, features and advantages of the present invention will become apparent upon examination of the following description and drawings dealing with several specific embodiments thereof.

DESCRIPTION OF THE PREFERRED EMBODIMENT

Figure 1:
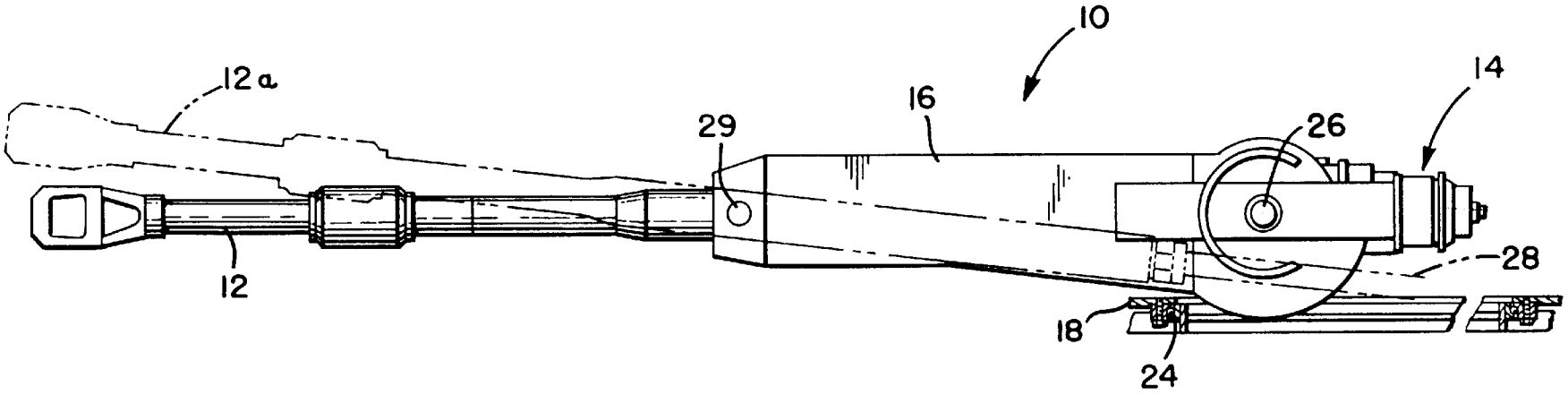
FIG. 1 is an assembly drawing of the present invention with the gun tube, shown in phantom, tipped at an angle to accept a projectile.

The preferred embodiment of the present invention is shown in FIG. 1. Gun assembly 10 comprises barrel 12 connected to the combustor and breech assembly 14. Cradle structure 16 encloses barrel 12 and breech assembly 14. Further, gun assembly 10 is supported at chassis deck 18. Deck 18 comprises bearings 24 to enable azimuth drive and trunnions 26 to enable elevation drive. The break action feature is depicted by barrel 12*a* which is rotatably tipped about fulcrum 29. Projectile feed path 28 is shown at breech end of cannon 12*a*.

Figure 2A:
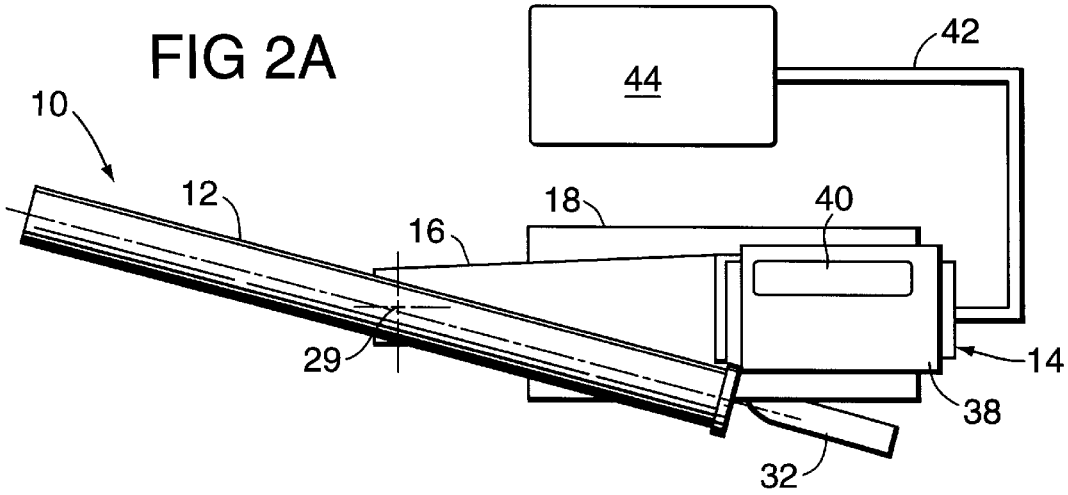
FIG. 2A is a block diagram showing the integration of the present invention with an internal and external propellant supply. The gun tube is shown in a disengaged position inclined to accept a projectile.

FIG. 2A is a block diagram depicting the integrability and flexibility of the present invention. In the preferred embodiment, a propellant charge system is integrated with the components of the present invention. In FIG. 2A, barrel 12 is shown in a tipped position, accepting projectile 32 via projectile path 28. Breech assembly 14 houses combuster compartment 38 and internal propellant supply 40. The component assembly is mounted on chassis or deck mount 18. Feed line 42 connects internal propellant supply 40 to external propellant storage 44. In the embodiment shown, breech assembly 14 is open.

Figure 2B:
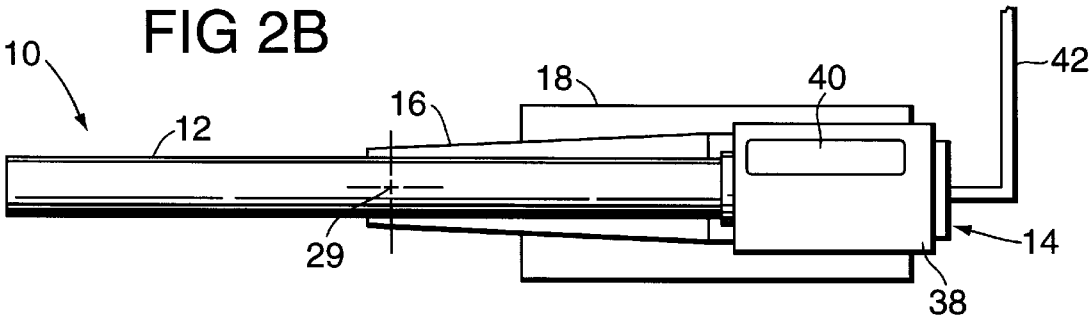
FIG. 2B is a block diagram showing the barrel coupled to a closed breech.

FIG. 2B is a block diagram showing barrel 12 in engagement with breech assembly 14. It depicts a sequential stage of FIG. 1 where breech assembly 14 is closed and the gun is ready to fire.

Figure 3A:
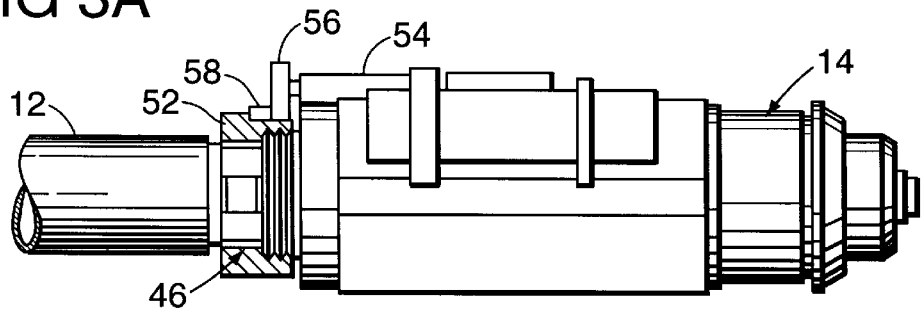
FIG. 3A is a detail drawing showing connections between the barrel and the breech assembly.

FIG. 3A shows the preferred embodiment connections between barrel 12 and breech assembly 14. Breech end of barrel 12 comprises machined surfaces and interrupted threads 46 designed to provide a secure connection between barrel 12 and breech assembly 14. Barrel locking collar 52 connects barrel 12 with breech assembly 14. Further, actuator 54 is mounted on breech assembly 14 and operates barrel locking collar 52. Drive gear 56 is in mechanical contact with gear sector 58. Gear sector 58 is a part of barrel locking collar 52.

Figure 3B:
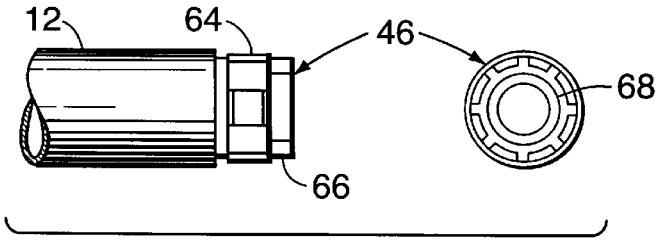
FIG. 3B is a detail drawing of a face seal and the breech end of the barrel.

FIG. 3B is a detail of machined surfaces 46 comprising the breech end of barrel 12. Interrupted lug threads 64 are formed adjacent to octagonal barrel pilot 66. Octagonal barrel pilot 66 comprises the breech end point of barrel 12 and transmits rifling torque to the breech and subsequently to the cradle and other supporting structure. Obturator 68 forms a face seal as shown.

Figure 4A:
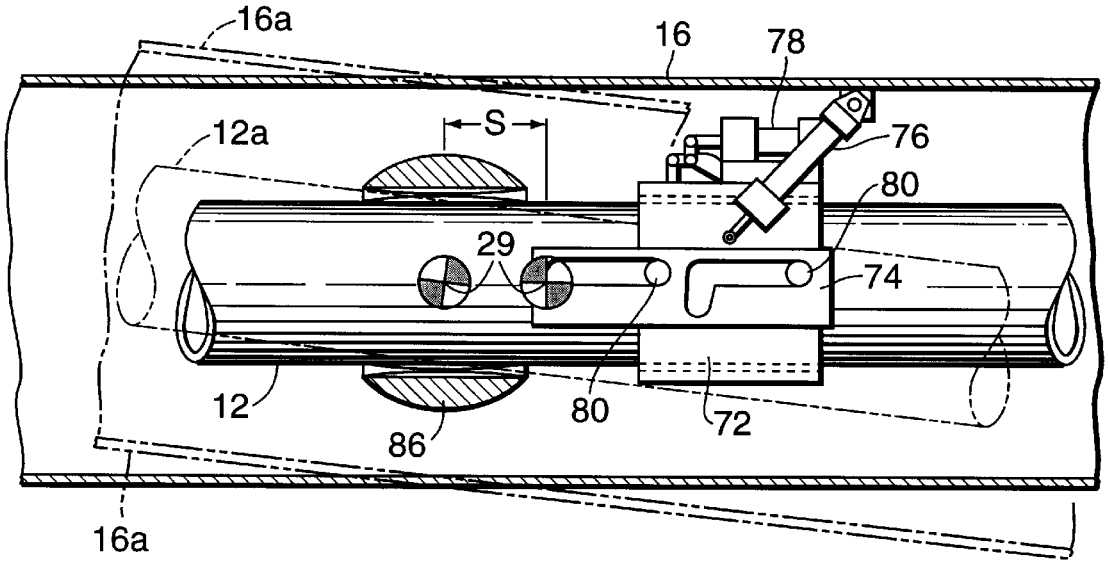
FIG. 4A is an enlarged elevation view of the barrel shifting and tipping mechanism.
Figure 4B:
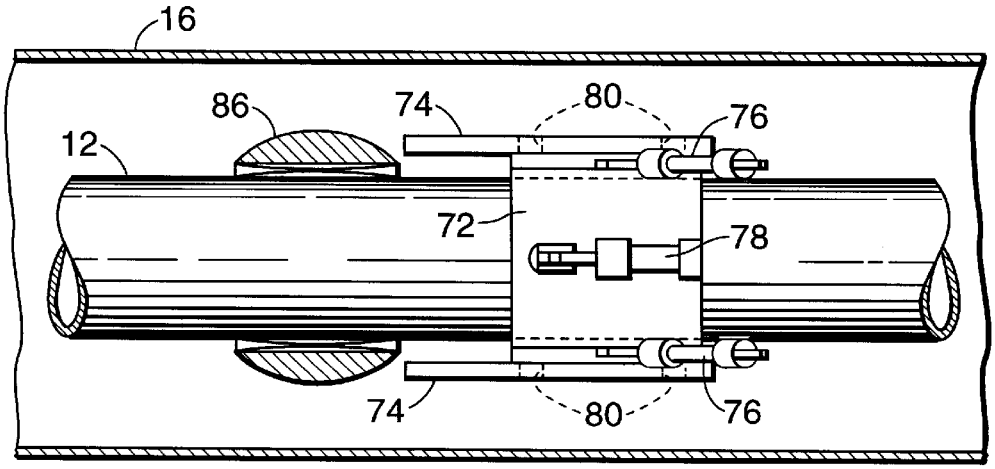
FIG. 4B is an enlarged plan view of the barrel shifting and tipping mechanism.

Referring now to FIGS. 4A and 4B, the barrel shifting and tipping mechanism is shown in elevation (FIG. 4A) and plan (FIG. 4B) views. In FIG. 4A, barrel 12 is shown with barrel shift collar 72. Barrel shift collar 72 mounts into cam plates 74 which are mounted to the cradle structure 16. Barrel shift actuator 76 is connected to barrel shift collar 72 at one end and cradle structure 16 (See also FIG. 1) at the other. Barrel/Collar lock and actuator 78 is centrally disposed between barrel shift actuators 76 and is mounted on barrel shift collar 72. Cam follower 80 is attached to barrel shift collar 72. Barrel bearing 86 is mounted in cradle structure 16 (See also FIG. 1). In FIG. 4A shifted barrel 12*a* and cradle 16*a* are shown in broken lines indicating a tipping through a certain angle and a linear shift designated by "S".

The disclosure hereinabove relates to some of the most important structural features and organizations of the preferred embodiment. The functional and operational features are discussed hereinbelow.

Referring to FIG. 1, gun assembly 10 is shown wherein barrel 12 is normally engaged with breech assembly 14. Further, barrel 12*a* indicates the break action of the present invention. Here, the barrel is detached from breech assembly 14 and is ready to accept a projectile via projectile feed path 28. Some of the significant details of the break action, in the preferred embodiment, are discussed hereinbelow.

FIGS. 2A and 2B depict the operation of the break action cannon invention in conjunction with a regenerative liquid propellant system. In FIG. 2A, barrel 12 is tipped to accept projectile 32. In this set up, breech assembly 14 is open to refill/refurbish internal liquid propellant supply 40. The propellant mass is transmitted via feed line 42 which is connected to external propellant storage 44. As indicated in FIG. 2A, combuster compartment 38 in breech assembly 14, houses internal liquid propellant supply 40. When projectile 32 is loaded into barrel 12 and propellant is refurbished, breech assembly 14 is closed and barrel 12 engaged as shown in FIG. 2B.

In FIG. 3A, the connection between barrel 12 and breech assembly 14 is shown in detail. This connection is one of the significant aspects of the present invention and is therefore set forth in detail. The connection comprises, Barrel locking collar 52 and barrel lock/unlock actuator 54. Breech end of barrel 12 comprises machined surface 46 (See FIG. 3B). Machined surface 46 includes, interrupted lug threads 64 and octagonal barrel pilot 66. Further, obturator 68 forms a face seal. Barrel locking collar 52 includes a quarter turn interrupted lug internal threads to lock barrel 12 and breech assembly 14 for firing. Further, the connection between barrel locking collar 52 and breech assembly 12 compresses obturator 68 to thereby seal combustion gases.

More particularly, interrupted lug threads 64 and octagonal barrel pilot 66 form a snug fit between barrel 12 and breech assembly 14 such that torque loads due to barrel 12 rifling are transferred. Heretofore, threaded connections are used between a barrel and a breech block to absorb firing pressures and resultant stresses. However, in the preferred embodiment of the present invention, the interrupted lug threads 64 provide a structural connection with barrel locking collar 52. Octagonal barrel pilot 66 are designed both to transmit rifling torque to breech assembly 14 and trunnions 26 (see FIG. 1) and further enable a quick disconnect to promote the break action operation. Barrel lock/unlock actuator 54 is attached to cradle 16 (See FIG. 1). Drive gear 56 provides a positive static lock position and extends forward and rotates barrel locking collar 52 to either unlock or lock barrel 12 and breech assembly 14. Gear sector 58 is part of barrel locking collar 52 and is operated by drive gear 56.

Accordingly, when the break action of barrel 12 is initiated, barrel lock/unlock actuator 54 starts drive gear 56. Thereafter, drive gear 56 urges gear sector 58 and barrel locking collar 52 is rotated through a quarter turn to detach barrel 12 at interrupted lug threads 64. This retains barrel locking collar 52 secured to breech assembly 14 while releasing barrel 12. Particularly, obturator 68 is uniquely adaptable to repeated connection and disconnection cycles of barrel 12 and is replaceable as needed to maintain a positive pressure in the gun chamber and barrel 12 and to seal combustion gases therein.

During the detachment of barrel 12 from breech assembly 14, in the manner discussed hereinabove, barrel shift actuator 76 extends forward to drive barrel shift collar 72 forward. Cam plates 74, which are attached to cradle 16, guide the fore shift and tipping of barrel 12. Barrel/collar lock and actuator 78 locks barrel 12 to barrel shift collar 72 so they can together shift forward and tip. Barrel shift collar 72 mounts into cam plates 74 and maintains a controlled movement in the cam path. Cam followers 80 are attached to barrel shift collar 72 and are guided in the cradle mounted cam plates 74. When barrel 12 is thus shifted forward barrel bearing 86 guides barrel 12 and allows it to tip for projectile loading. One of the unique aspects of the break action cannon invention is the forward shifting of barrel 12 to provide tipping in order to create swing space and volume for loading projectiles without interfering with breech operations. The present invention accomplishes this advantage by employing simple and yet efficient mechanisms. More particularly, when barrel 12 is shifted a distance "S" forward, barrel bearing 86 in cooperation with cam plates 74 and cam followers 80 tip barrel 12 thus implementing the break action.

Barrel 12 is returned back to its original aligned position relative to breech assembly 14 when barrel shift actuator 76 is retracted and drives barrel shift collar 72 backwards and as well pulls barrel 12 via cam followers 80 which are guided in cam plates 74. Cam plates 74 thus guide the backward shift, and pull barrel 12 back up from its tipped position. Barrel/collar lock and actuator 78 locks barrel 12 to barrel shift collar 72 so that barrel 12 can shift backwards and return back to a non-inclined position. Thus, the forward and backward movements of barrel/collar lock and actuator 78 enable a forward shift or a backward pull of barrel 12 as indicated.

Accordingly, when breech end of barrel 12 is pulled into barrel locking collar 52, drive gear 56 extends forward and rotates barrel locking collar 52 to lock barrel 12 to breech assembly 14 thereby completing a cycle of the break action cannon.

While a preferred embodiment of the break action cannon has been shown and described, it will be appreciated that various changes and modifications may be made therein without departing from the spirit of the invention as defined by the scope of the appended claims.

What is claimed is:

1. A gun system comprising a propellant charge in conjunction with a combuster housing to accelerate a projectile in a gun tube further comprising:

a breech end of said gun tube integrated with the combuster housing;

an internal propellant charge supply system contained in the combuster housing;

an external propellant charge supply in communication with said internal propellant charge supply system and disposed outside the combuster housing; and the breech end of the gun tube being angularly and detachably integrated with said combuster housing and in communication therewith.

2. The gun system of claim 1 wherein the breech end of the gun tube is maneuverable to allow access to refill said internal propellant charge supply system from said external supply.

3. A gun system comprising a movable barrel and internal propellant charge supply integrated with a combuster compartment to accelerate a projectile in the movable barrel comprises a mechanism for tipping angularly and shifting linearly out of axial alignment with a breech assembly for projectile loading, the gun system comprising:

a breech assembly housing said propellant charge supply and said combuster compartment;

the breech assembly mounted on a chassis;

means for connecting an external propellant charge supply to said internal propellant charge supply in the breech assembly; and the movable barrel being independently supported by the mechanism for tipping angularly and shifting linearly whereby the projectile can be directly loaded into the movable barrel out of said alignment with said breech assembly.

4. The gun system of claim 3 wherein said mechanism for tipping angularly and shifting linearly the movable barrel further includes:

a barrel bearing forward of said breech and supporting said movable barrel;

an extendable barrel shift actuator;

said shift-collar being in drivable connection with said extendable barrel shift actuator;

cam plates attached to said cradle structure;

a barrel/collar lock and actuator;

said barrel/collar lock and said shift collar attached to said movable barrel;

said barrel shift collar mounted into said cam plates;

cam followers attached to said barrel shift collar;

said cam followers further guided in said cam plates;

said barrel bearing shifting the movable barrel forward and in cooperation with said cam plates and said cam follower tipping the movable barrel.

5. The gun system of claim 4 wherein said mechanism for tipping angularly and shifting linearly is structured to enable said tipping and shifting simultaneously in a single step of operation.

6. The gun system of claim 3 wherein said mechanism for tipping angularly and shifting linearly includes a cradle structure and a shift collar.

7. A gun system including a liquid propellant supply integrated with a combuster compartment in a breech assembly wherein a barrel having a first end, an intermediate section and a second end is in one of axial and non-axial alignment with said breech assembly, the gun system comprising:

the liquid propellant supply wherein an internal propellant supply is disposed in said combuster compartment and an external propellant supply is connected to said internal propellant supply;

the first end of the barrel adapted to load a projectile;

the intermediate section of the barrel including:

a cradle structure, cam plates, a barrel shift collar mounted onto said cam plates, a barrel shift actuator connected to said barrel shift collar and said cradle structure, a barrel collar lock and actuator centrally disposed intermediate said barrel shift actuator and mounted on said barrel shift collar, a cam follower attached to said barrel shift collar, a barrel bearing mounted in said cradle structure; and said cradle structure, said cam plates, said barrel shift collar, said barrel shift actuator, said barrel collar lock and actuator, said cam follower and said barrel bearing in combination forming a mechanism for shifting and tipping the barrel to bring the barrel in said non-axial alignment with said breech assembly; and the second end of the barrel forming a muzzle.

8. The gun system of claim 7 wherein interrupted lug threads and octagonal barrel pilot form a snug fit between the barrel and the breech assembly forming said axial alignment and further forming a structural connection to transfer torque loads from the barrel to the breech assembly.

9. The gun system of claim 8 wherein said structural connection to transfer torque loads includes said octagonal barrel pilot adapted to transmit rifling torque to said breech assembly and trunions and forming a quick disconnect therewith to enable said one of axial and non-axial alignment with said breech assembly.

10. A method for separating a gun barrel from a breech-block and a combuster compartment to ram a projectile into the gun barrel and to supply a propellant charge supply to an internal propellant charge supply comprising the steps of:

detaching the gun barrel from the combuster compartment;

simultaneously shifting linearly and tipping angularly the gun barrel out of axial alignment with the breech block;

ramming the projectile when the gun barrel is in said out of axial alignment with the breech block;

supplying the propellant charge supply to said internal propellant charge supply.

11. The method according to claim 10 wherein said step of tipping angularly the gun barrel includes positioning the gun barrel at an angle to align a ram to load the projectile.

12. The method according to claim 10 wherein said step of supplying the propellant charge supply includes the step of transmitting a liquid propellant supply via a feed line connected to said internal propellant supply.

* * * * *